US011393347B2

(12) United States Patent
Rey et al.

(10) Patent No.: US 11,393,347 B2
(45) Date of Patent: Jul. 19, 2022

(54) CELLULAR AERIAL VEHICLE TRAFFIC CONTROL SYSTEM AND METHOD

(71) Applicant: Moog Inc., East Aurora, NY (US)

(72) Inventors: Gonzalo J. Rey, Clarence Center, NY (US); Ralph M. Kling, Sunnyvale, CA (US)

(73) Assignee: Moog Inc., East Aurora, NY (US)

( * ) Notice: Subject to any disclaimer, the term of this patent is extended or adjusted under 35 U.S.C. 154(b) by 21 days.

(21) Appl. No.: 15/759,649

(22) PCT Filed: Jul. 25, 2016

(86) PCT No.: PCT/US2016/043867
§ 371 (c)(1),
(2) Date: Mar. 13, 2018

(87) PCT Pub. No.: WO2017/048363
PCT Pub. Date: Mar. 23, 2017

(65) Prior Publication Data

US 2018/0253979 A1 Sep. 6, 2018

Related U.S. Application Data

(60) Provisional application No. 62/220,806, filed on Sep. 18, 2015.

(51) Int. Cl.
*G08G 5/00* (2006.01)

(52) U.S. Cl.
CPC ..... *G08G 5/0069* (2013.01); *G08G 5/006* (2013.01); *G08G 5/0013* (2013.01); (Continued)

(58) Field of Classification Search
CPC .. G08G 5/0013; G08G 5/0082; G08G 5/0026; G08G 5/0043; G08G 5/0069; G08G 5/0039; G08G 5/006
See application file for complete search history.

(56) References Cited

U.S. PATENT DOCUMENTS 6,243,647 B1 * 6/2001 Berstis ..... G01S 5/0072 340/8.1
6,262,679 B1 7/2001 Tran
(Continued)

FOREIGN PATENT DOCUMENTS

EP 1857904 A1 11/2007
GB 2252019 A 7/1992
(Continued)

OTHER PUBLICATIONS

The International Search Report (ISR) and Written Opinion of the searching authority for PCT Application Serial No. PCT/US2016/043867; Publication No. WO 2017/048363 A1; dated Oct. 25, 2016.
(Continued)

*Primary Examiner* — Redhwan K Mawari
(74) *Attorney, Agent, or Firm* — Harter Secrest & Emery LLP

(57) ABSTRACT

An aerial vehicle traffic control system comprising a ground system, an unmanned aerial vehicle, a wireless communications link between the ground system and the unmanned aerial vehicle, the unmanned aerial vehicle configured to travel in a three-dimensional airspace, the three-dimensional airspace partitioned into multiple individual three-dimensional virtual cells, a database having a unique authorization token associated with each of the virtual cells, a transaction processing engine configured to assign each token in the database to no more than one unmanned aerial vehicle at a time, and a controller configured to control the unmanned aerial vehicle such that the unmanned aerial vehicle is restricted from entering a cell without first being assigned the token for such cell.

34 Claims, 10 Drawing Sheets

(52) U.S. Cl.
CPC ..... *G08G 5/0026* (2013.01); *G08G 5/0043* (2013.01); *G08G 5/0082* (2013.01)

(56) References Cited

U.S. PATENT DOCUMENTS

| | | | | |
|---|---|---|---|---|
| 7,266,477 | B2 * | 9/2007 | Foessel | G01S 13/862 701/1 |
| 7,499,774 | B2 | 3/2009 | Barrett et al. | |
| 7,979,172 | B2 * | 7/2011 | Breed | G08G 1/161 701/23 |
| 8,229,716 | B2 | 7/2012 | Kaplan et al. | |
| 8,234,068 | B1 * | 7/2012 | Young | G08G 5/0069 701/410 |
| 8,463,461 | B2 | 6/2013 | Estkowski et al. | |
| 8,682,521 | B2 | 3/2014 | Mach et al. | |
| 8,965,561 | B2 | 2/2015 | Jacobus et al. | |
| 9,014,880 | B2 | 4/2015 | Durling et al. | |
| 9,020,663 | B2 | 4/2015 | Smith et al. | |
| 9,087,451 | B1 | 7/2015 | Jarrell | |
| 9,858,825 | B2 * | 1/2018 | Vilaplana | G08G 5/0039 |
| 2003/0227395 | A1 | 12/2003 | Zeineh | |
| 2005/0090978 | A1 | 4/2005 | Bathory et al. | |
| 2007/0162197 | A1 | 7/2007 | Fleming | |
| 2012/0303253 | A1 * | 11/2012 | Irfan | G08G 5/0082 701/120 |
| 2014/0229094 | A1 | 8/2014 | La Civita et al. | |
| 2015/0254988 | A1 | 9/2015 | Wang et al. | |
| 2016/0117931 | A1 * | 4/2016 | Chan | B64C 39/024 701/120 |
| 2017/0045894 | A1 * | 2/2017 | Canoy | G06V 20/13 |
| 2018/0253979 | A1 * | 9/2018 | Rey | G08G 5/0043 |

FOREIGN PATENT DOCUMENTS

| | | | | |
|---|---|---|---|---|
| GB | 1 857 904 | A1 * | 11/2007 | G05D 1/10 |
| JP | 2000214254 | A | 8/2000 | |

OTHER PUBLICATIONS

The (113/373) International Preliminary Report on Patentability Chapter I for International Patent Application No. PCT/US2016/043867; Publication No. WO 2017/048363 A1; dated Mar. 20, 2018.
Dicheva et al., "Route Finding for An Autonomous Aircraft" American Institute of Aeronautics and Astronautics, 2011.
Wu et al., "On-board Multiobjective Mission Planning for Unmanned Aerial Vehicles." In: IEEE Aerospace Conference, Mar. 7-14, 2009, Big Sky, Montana. 2009.

* cited by examiner

CELLULAR AERIAL VEHICLE TRAFFIC CONTROL SYSTEM AND METHOD

TECHNICAL FIELD

The present invention relates generally to the field of aerial vehicle control systems and more particularly to an unmanned aerial vehicle airspace control and authorization system.

BACKGROUND ART

Air traffic is controlled primarily by humans, assisted by tools that help provide separation and safety in highly congested areas such as airports. The controller seeks to preserve separation in terms of time of flight between aircraft based on a freeze-frame image of the aircraft in their charge. Emerging 4D trajectory modeling technology enhances the ability of air traffic controllers to predict and avoid conflicts. Current systems are able to propose routing solutions to avoid compromised separation. Fundamentally, past, current and emerging tools work in an "analog" paradigm where the airspace is a continuum and the aircraft "fly" across it.

Mobile telephones use a cellular network of towers that allow an uninterrupted call to be held as the caller travels among the range of the towers. The hand-off from tower to tower occurs automatically. The system is transparent to service providers, allowing roaming from one provider to the other. The system does not rely upon knowing the speed or bearing or routing of the mobile telephone. The hand off is primarily initiated by the strength of the radio signal. At any given time, the mobile phone is connected to a single tower.

BRIEF SUMMARY OF THE INVENTION

With parenthetical reference to the corresponding parts, portions or surfaces of the disclosed embodiment, merely for purposes of illustration and not by way of limitation, an air traffic control method is provided comprising the steps of partitioning a three-dimensional airspace (16) into multiple individual three-dimensional virtual cells (18), providing a unique token (52) for each virtual cell in the airspace, requesting (105) assignment of the token for a selected cell (18*b*) to an unmanned aerial vehicle (19), and determining (106) whether or not to assign the token for the selected cell to the unmanned aerial vehicle as a function of whether or not the token for the selected cell is available (308) for assignment to the unmanned aerial vehicle.

The method may comprise the step of restricting (110) the unmanned aerial vehicle from entering the selected cell without the unmanned aerial vehicle first acquiring (107) the token for the selected cell. The method may comprise the step of assigning (207) the token for the selected cell to the unmanned aerial vehicle. The method may comprise the step of the unmanned aerial vehicle entering (108) the selected cell from an adjacent cell (18*a*). The method may comprise the step of releasing (109) the token for the adjacent cell after the unmanned aerial vehicle leaves the adjacent cell. The method may comprise the step of retrieving (209) the token for the adjacent cell from the unmanned aerial vehicle after a predetermined expiration time (402).

The selected cell may be in a desired aerial route (21) of the unmanned aerial vehicle. The unmanned aerial vehicle may comprise an onboard global positioning system (23) and may comprise the step of determining (102, 103) the cell in which the unmanned aerial vehicle is located. The step of determining whether or not to assign the token for the selected cell to the unmanned aerial vehicle may be a function of a radar system (24, 25) that verifies (309, 411) whether or not the selected cell is available to the unmanned aerial vehicle. The step of determining whether or not to assign the token for the selected cell to the unmanned aerial vehicle may be a function of a priority designation applied to the unmanned aerial vehicle. The method may comprise the step of auditing (409) token assignments to assure that each token is assigned to only one unmanned aerial vehicle at a time. The method may comprise the step of determining a destination cell of the unmanned aerial vehicle and the airspace and calculating an aerial route to the destination cell. The method may comprise calculating an alternate aerial route to the destination cell.

The virtual cells may not have the same volume. The step of requesting assignment of a token for the selected cell to the unmanned aerial vehicle may comprise the step of sending a wireless signal (32, 33, 34) via a wireless communication network (26, 27) from the unmanned aerial vehicle to a ground control system (17). The wireless communication network may comprise a cellular infrastructure and dedicated frequency channels. The method may comprise the step of assigning a second token for a second selected cell (18*c*) to the unmanned aerial vehicle. The method may comprise the step of restricting the unmanned aerial vehicle from acquiring more than a predetermined maximum number of tokens at a given time.

In another aspect, an unmanned aerial vehicle traffic control system (15) is provided comprising a ground system (17), an unmanned aerial vehicle (19), a wireless communications link (32) between the ground system and the unmanned aerial vehicle, the unmanned aerial vehicle configured and arranged to travel in a three-dimensional airspace (16), the three-dimensional airspace partitioned into multiple individual three-dimensional virtual cells (18), a database (37) having a unique token (52) associated with each of the virtual cells, a transaction processing engine (29) configured to assign each token in the database to no more than one unmanned aerial vehicle at a time, and a controller (22) configured to control the unmanned aerial vehicle such that the unmanned aerial vehicle is restricted from entering a cell without first being assigned the token for the cell.

The transaction processing engine may be configured to retrieve (209) from the unmanned aerial vehicle a token for a cell after the unmanned aerial vehicle leaves the cell. The transaction processing engine may be configured to retrieve (405) from the unmanned aerial vehicle the token for the cell after the unmanned aerial vehicle leaves the cell as a function of elapsed time (402) from assignment of the token to the unmanned aerial vehicle. The unmanned aerial vehicle may comprise a global positioning system. The ground system may comprise a radar system (24, 25) and the transaction processing engine may be configured to obtain a verification (309, 411) from the radar system that a cell is available to the unmanned aerial vehicle before assigning a token for the cell to the unmanned aerial vehicle. The transaction processing engine may be configured to audit token assignments to assure that each token is assigned to only one unmanned aerial vehicle at a time. The ground system may comprise multiple separately located ground stations (24, 25, 26, 27, 29). The system may comprise multiple unmanned aerial vehicles (19, 20). The wireless communication link between the ground system and the unmanned aerial vehicle may comprise a cellular infrastructure and dedicated frequency channels. The system may further comprise a redundant back-up database. The transaction processing engine may be configured to assign multiple tokens in the database to one unmanned aerial vehicle at the same time. The transaction processing engine may be configured to restrict the unmanned aerial vehicle from acquiring more than a predetermined maximum number of tokens at a given time.

In another aspect, an air traffic control system is provided comprising a three-dimensional airspace (16) partitioned into multiple individual three-dimensional virtual cells (18), a unique authorization token (52) for each of the virtual cells, a traffic controller (29) configured to assign each token to no more than one aerial vehicle at a time, a communications network (29, 35*a*, 35*b*, 26, 27) between the aerial vehicle and the traffic controller configured to allow the traffic controller to selectively assign the tokens to the aerial vehicle, and a vehicle controller (22) configured to control the aerial vehicle such that the aerial vehicle is restricted from flying into a cell without being assigned (207) the token for the cell.

The communications network between the aerial vehicle and the traffic controller may be configured to allow the traffic controller to selectively retrieve (209) the tokens from the aerial vehicle. The vehicle controller may be configured to selectively request (105) and acquire (107) the tokens. The vehicle controller may be configured to selectively release (109) the tokens. The traffic controller may selectively record either an assigned or a free token state in a database (37).

DETAILED DESCRIPTION OF THE PREFERRED EMBODIMENTS

Figure 1:
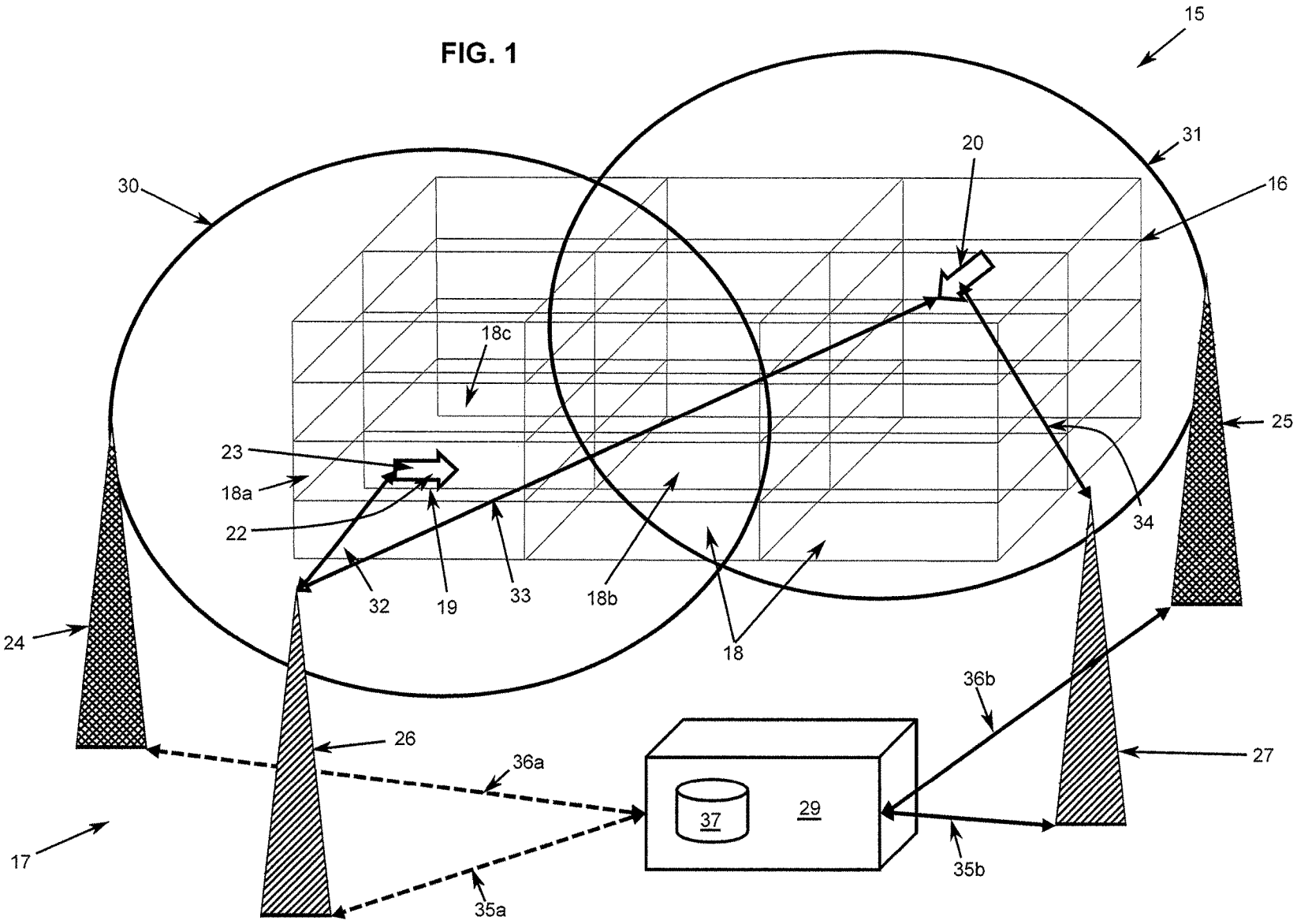
FIG. 1 is a schematic view of a first embodiment of an improved aerial vehicle traffic control system.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., crosshatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly to FIG. 1 thereof, an aerial vehicle traffic control system is provided, an embodiment of which is generally indicated at 15. As shown, system 15 generally includes ground system 17, aerial vehicles 19 and 20 having control and communication electronics 22, and traffic controller 29. As shown, ground control system 17 includes wireless communication towers 26 and 27 that, via ground links 35*a* and 35*b*, respectively, provide wireless communication links 32, 33 and 34 between aerial vehicles 19 and 20 and traffic controller 29. In this embodiment, ground system 17 also includes radar towers 24 and 25 having radar coverage 30 and 31, respectively, of airspace 16. Traffic controller 29 is in communication with radar towers 20 and 25 via ground links 36*a* and 36*b*, respectively.

In this embodiment, vehicles 19 and 20 are unmanned aerial vehicles (UAVs) authorized to travel through airspace 16, which is partitioned for traffic control purposes into multiple virtual cells, severally indicated at 18. However, it is contemplated that manned or other types of aerial vehicles may be used with system 15 or that system 15 may be used in conjunction with other air traffic control systems for other types of aerial vehicles.

Figure 2:
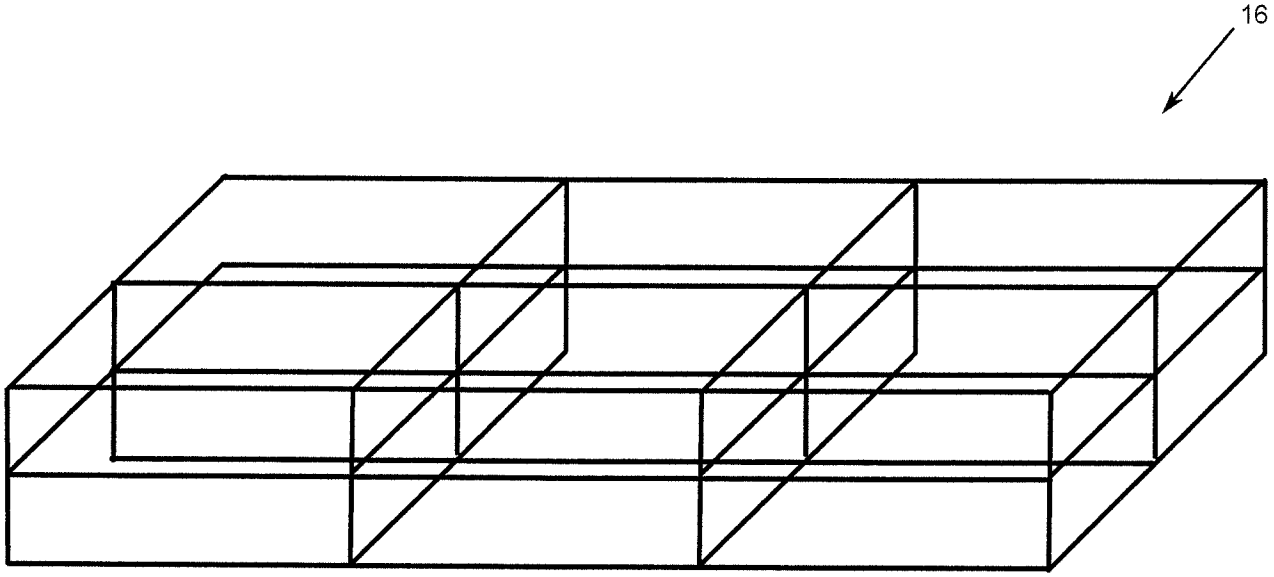
FIG. 2 is a partial view of the three-dimensional airspace cell partitions shown in FIG. 1.
Figure 3:
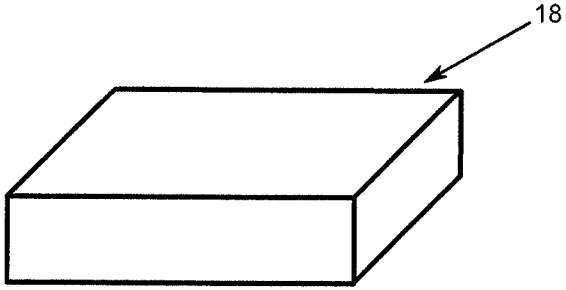
FIG. 3 is a view of an individual virtual cell shown in FIG. 2.
Figure 4:
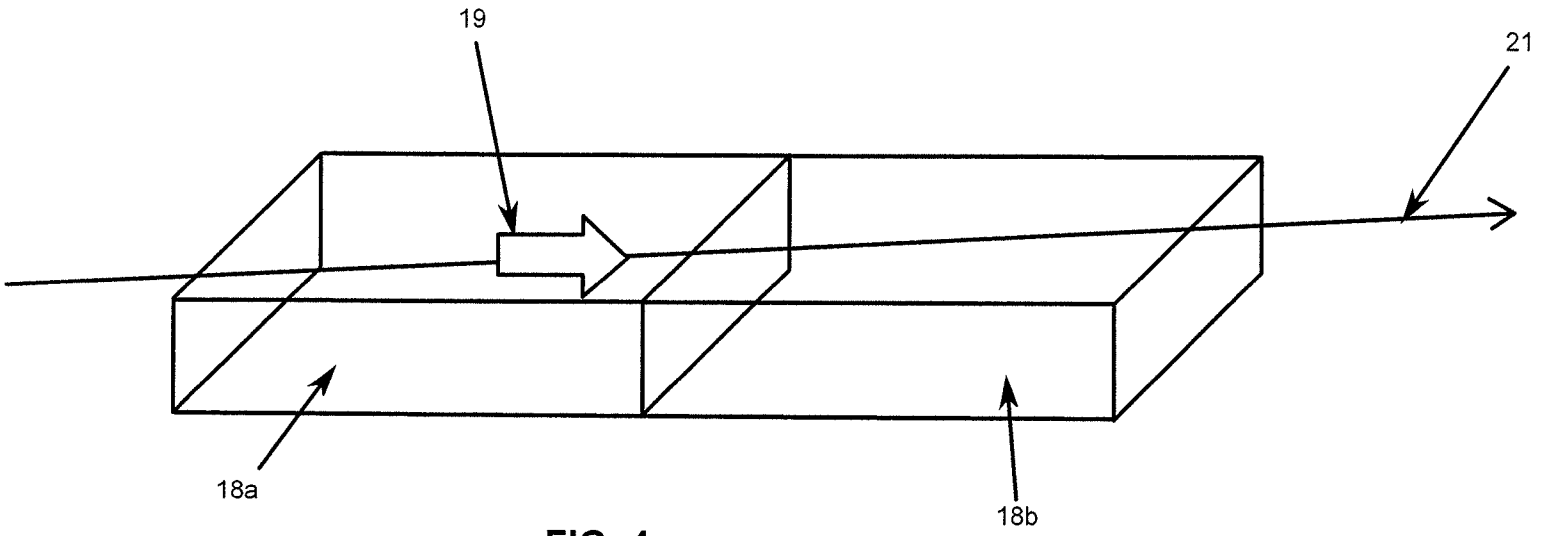
FIG. 4 is a partial view of the aerial vehicle route through cells shown in FIG. 1.

As shown in FIGS. 1-3, airspace 16 is partitioned into individual virtual three-dimensional cells. As shown in FIGS. 2 and 3, a single rectangular 3D cell 18 is arranged in a non-overlapping grid 16. The cells seamlessly abut each other in all dimensions. This ensures that all space is controlled by the system. Thus, airspace 16 is represented by a cellular list of cell spatial definitions and designators. While this partition is shown as a uniform three-dimensional grid in FIGS. 1-3, with the volume of each cell being the same, the volumes of the cells may vary and the size and configuration of each cell may be modified to be consistent with the maneuvering capabilities of the aerial vehicles being supervised and with the regulatory requirements for such aerial vehicles. The size and shape of each individual cell is chosen based on the speed and maneuverability of the aerial vehicles that operate within it. For example, different cell volumes may be applied to fixed-wing versus rotary aircraft given the differences in speed and maneuverability. Furthermore, a hierarchy of cell structures and sizes may be created in which base level cells are grouped together and virtual tokens, which symbolize authorization for a vehicle to enter a cell as described below, are assigned for such groups as blocks. This could, for example, allow a fast moving aircraft to reserve sufficient cells along the flight path to ensure an efficient traversal of the control space without encountering short notice blockages. As shown in FIG. 4, two horizontally adjacent cells 18*a* and 18*b* are being traversed by vehicle 19 on flight path 21. Special provisions may be taken at the outer boundaries where vehicles first enter or finally exit airspace and grid 16.

Figure 5:
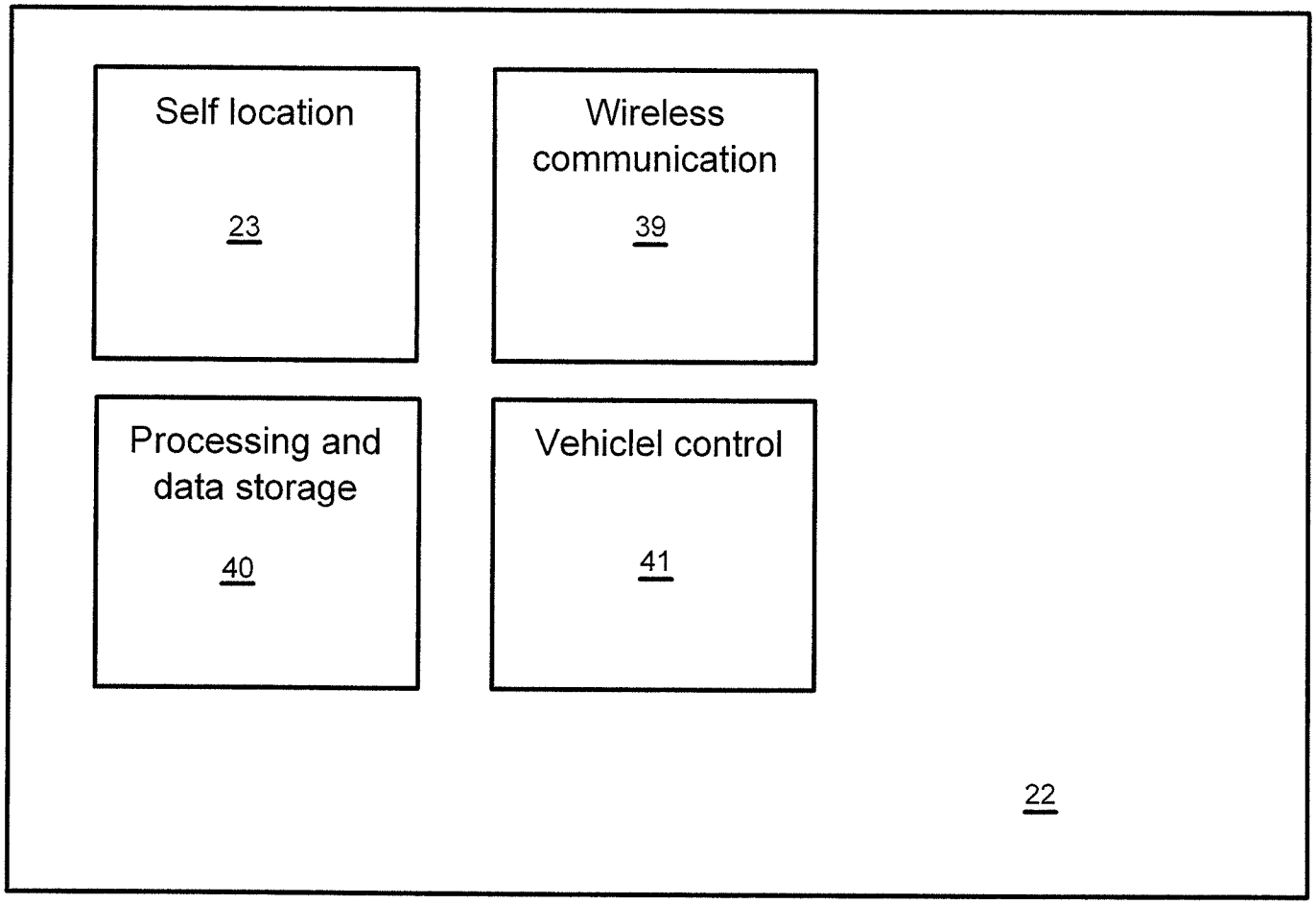
FIG. 5 is a schematic view of the aerial vehicle controller shown in FIG. 1.

As shown in FIG. 5, each of aerial vehicles 19 and 20 includes control and communication electronics 22. In this embodiment, electronics 22 includes global positioning system (GPS) 23, wireless communication transceiver 39, processor and data storage 40, and vehicle control system 41.

GPS 23 allows for vehicle 19 to determine its location in airspace 16 and to use that location to determine the cell 18*a* in which it is currently located and the boundaries of such cell, as well as the next cell 18*b* or cells in flight path 21 into and through which it wishes to travel. Thus, vehicle 19 is able to determine on an ongoing basis a relative distance to the boundaries of the cell in which it is located and a heading. Transceiver 39 transmits and receives wireless signals with towers 26 and 27 and allows vehicle 19 to communicate with traffic controller 29. Vehicle control system 41 actuates the flight controls of vehicle 19 to control the direction and speed of vehicle 19. Processor 40 receives inputs from GPS 23 and transceiver 39 and provides outputs to vehicle control 41.

Figure 7:
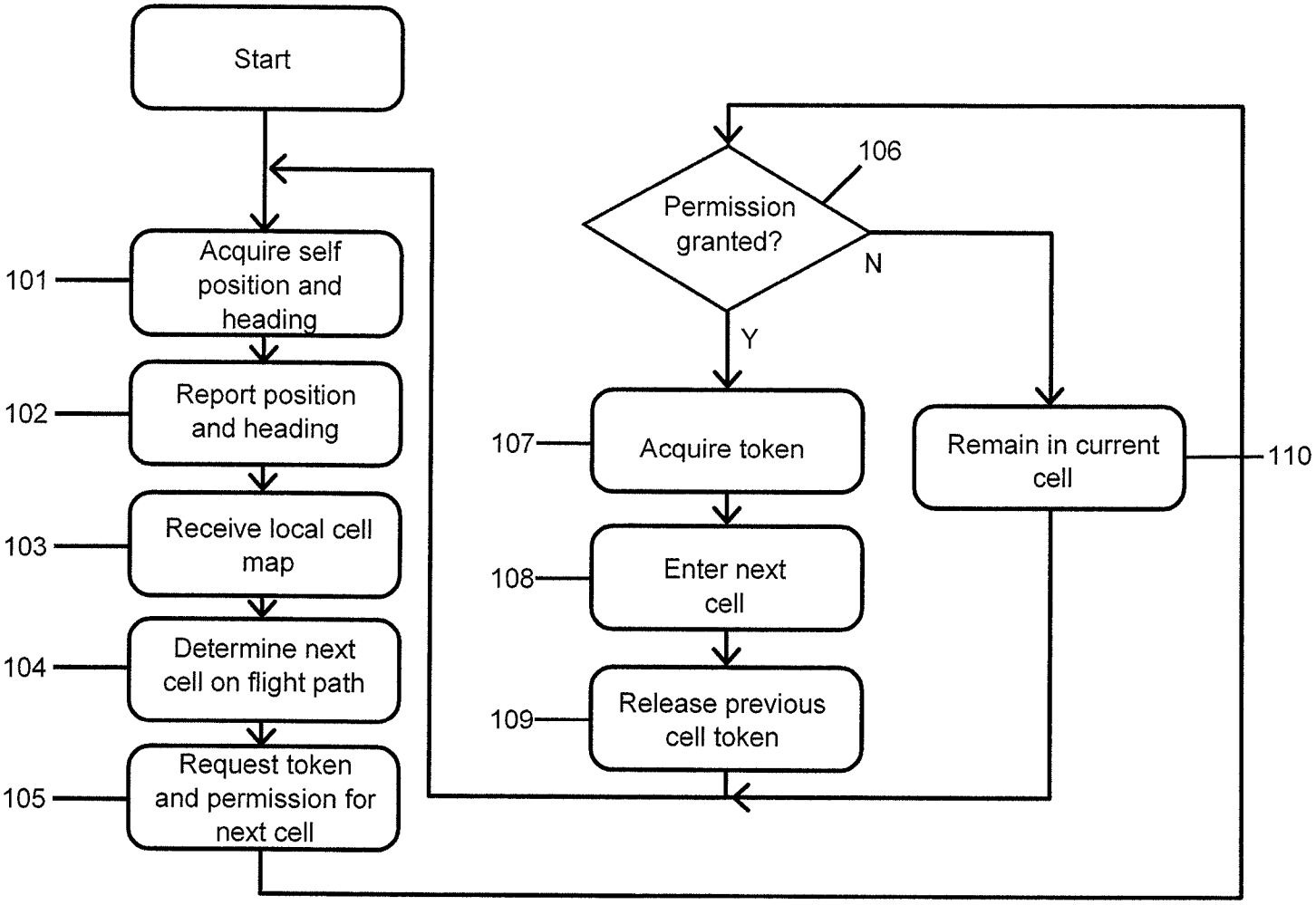
FIG. 7 is a controller processing method flow diagram.

As shown in FIG. 7, processor 40 is programed to perform a number of air traffic control functions. Before each transition between the cell in which vehicle 19 is located and the cell or block of cells vehicle 19 plans to enter, a sequence is followed. Processor 40 first acquires 101 its current position and heading via GPS 23. This position and heading is reported 102 via transceiver 39 to airspace traffic controller 29. A local cell map or list is provided by airspace traffic controller 29 and received 103 by vehicle 19 via transceiver 39. Based on preferred flight path 21 of vehicle 19, vehicle 19 identifies one or more cells for which it wishes to request a virtual token. A virtual token for a cell represents authorization for a vehicle to occupy the airspace within the boundaries of such cell. Thus, processor 40 determines 104 the next cell (for example 18*b*), or block of cells, vehicle 19 needs to enter to proceed along its flight path (for example, path 21). Vehicle 19 then requests 105 the token from airspace traffic controller 29 for the cell into which it wishes to enter via transceiver 39. As described further below, airspace traffic controller 29 either 106 responds affirmatively by assigning a token for such selected cell, or it does not assign a token for such selected cell, which acts as a denial of permission to enter such cell.

If a token is not assigned, and thus permission to enter such cell is not granted, vehicle 19 is directed by processor 40 and vehicle control 41 to remain 110 in its current cell (for example cell 18*a*). Vehicle 19 is not authorized to enter a cell of airspace without first acquiring the token or authorization for such cell. If a token is not assigned to vehicle 19, vehicle 19 remains in its current cell and processor 40 is programed to continue to periodically request 105 the token for such cell or to alternatively or simultaneously calculate an alternative route and begin to request assignment of a token for an alternative adjacent cell (for example cell 18*c*).

If on the other hand a token is assigned to vehicle 19 for such cell via transceiver 39, vehicle 19 receives or acquires 107 the token and, after acquiring the token, enters 108 such cell. After vehicle 19 enters the next selected cell (for example cell 18*b*), it releases 109 the token for the previous cell in which it was located (for example cell 18*a*) via transceiver 39. Once vehicle 19 releases the token for the previous cell in which it was located, the sequence begins again and continues in sequence for each transition between cells.

Thus, control and communication electronics 22 of each of aerial vehicles 19 and 20 acts as a confinement mechanism certified to keep the vehicle within the authorized cell or cells. It maintains a copy of the relevant cellular list of cell spatial definitions and designators, it maintains a list of tokens it has been assigned, it is able to establish its own position in relationship to cell boundaries, and it is steered so as to stay within the boundaries of the cell or cells corresponding to the token or tokens it has been assigned.

Figure 6:
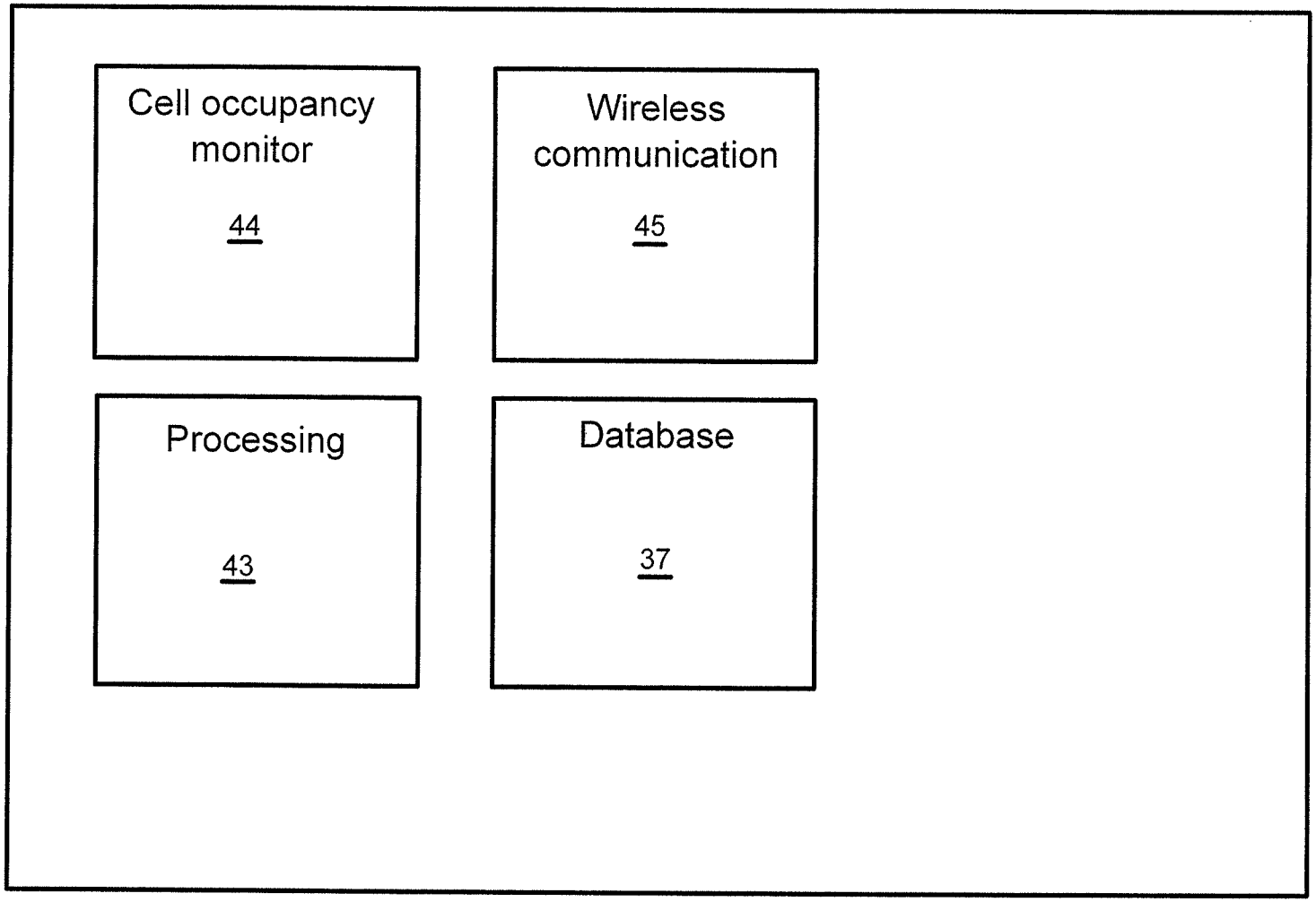
FIG. 6 is a schematic view of transaction processing engine shown in FIG. 1.

As shown in FIG. 6, traffic controller 29 generally includes central processor 43, token database 37, transceiver 45, and cell occupancy verification monitor 44. Transceiver 45 transmits and receives signals from towers 26 and 27 and allows for communication with vehicle 19. Cell occupancy verification monitor 44 monitors whether cells 18 in airspace 16 are occupied or not by aerial vehicles via radar stations 24 and 25. Processor 43 is configured to communicate with database 37, cell occupancy monitor 44 and transceiver 45.

Processor 43 is programed to follow a traffic control routine with respect to each vehicle and each and every vehicle transition from one cell to another cell (or block of cells) such that the traffic control is reduced to a single atomic transaction between an aerial vehicle and airspace traffic controller 29. At this level, traffic controller administers tokens by executing one of two transactions with respect to a cell, token assignment and token retrieval. If the state of the subject cell is "free" or available, the state is switched to "assigned" or not available and confirmed with the requesting vehicle. For token retrieval, the state of the released cell is set to "free" and confirmed with the vehicle.

Figure 8:
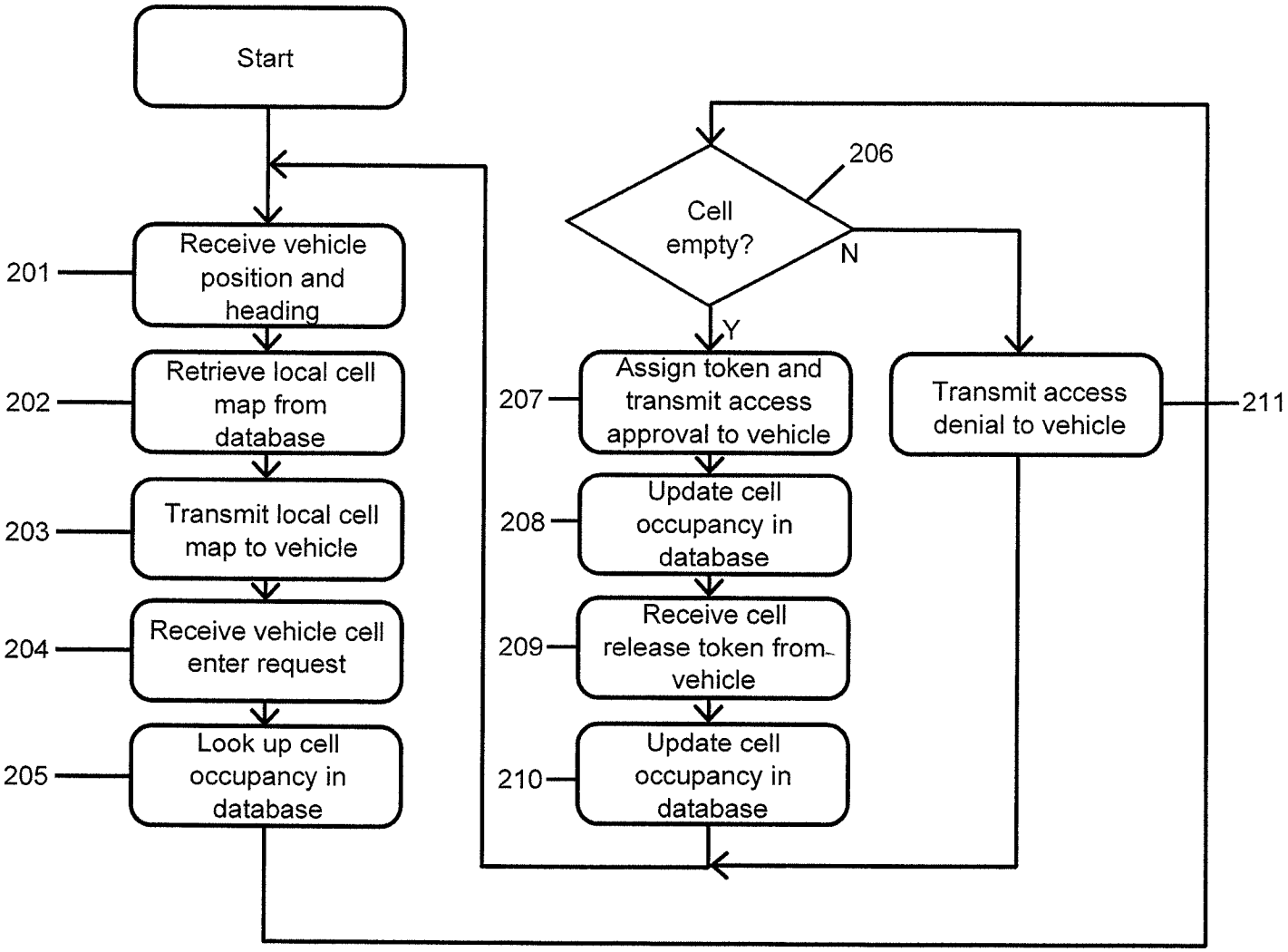
FIG. 8 is a transactional engine processing method flow diagram.
Figure 9:
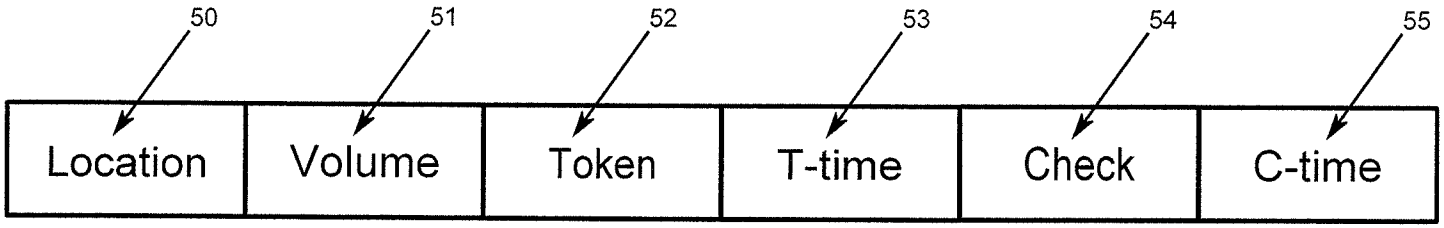
FIG. 9 is an example cell database record.

As shown in FIG. 8, aerial vehicle 19's position and heading is received 201 and the local cell map or list from database 37 is retrieved 202 and transmitted 203 to vehicle 19 via transceiver 45. A cell token assignment request is received 204 via transceiver 45. Processor 43 looks up the selected cell in database 37 to determine if the unique virtual token 52 for that cell is available or "free" for assignment to an aerial vehicle. The token in database 37 for a given cell will either be available or not available. As shown in FIG. 9, in this embodiment database record 37 stores for each and every cell 18 the location 50 of the subject virtual cell in three dimensional space (x, y, z), volume or size 51 of the subject cell in three dimensional space ($\Delta x$, $\Delta y$, $\Delta z$), authorization token state 52 for the subject cell, time stamp 53 of when the token was assigned and retrieved, radar virtual cell occupancy verification or check results 54, and time stamp 55 of the radar verification or check. Additional data may also be stored. Thus, database 37 stores a map of all of cells 18 and for each cell sets a token state for such cell of "free," in which case such cell is deemed empty, or "assigned," in which case such cell is deemed occupied. If assigned, a time stamp for when the token for such cell was assigned to the indicated vehicle is recorded and, as an option, a vehicle identification number for the indicated vehicle may be recorded.

If the token state is not "free," access denial is transmitted 211 to vehicle 19 via transceiver 45 and a token is not assigned to vehicle 19. As indicated above, without assignment of a token for a cell, the aerial vehicle cannot cross the boundary into such cell. If the token for the selected cell is "free" or available, subject to certain verification steps described below, the token is assigned 207 to vehicle 19 and access to the selected cell is approved via transceiver 45. Database 37 is simultaneously updated to reflect that the token state is "assigned" and is not available and the time 53 of such assignment, which indicates that the selected cell is occupied. The identification number of the vehicle the token was last assigned to may also be recorded. When vehicle 19 exits its current cell (for example 18*a*) and releases the token for such cell, the token for such cell is retrieved 209 and database 37 updated 210 to a token state of "free" to reflect that the token has been returned and is now available for that cell and the time of such retrieval.

This sequence is repeated for subsequent cells as vehicle 19 travels along route 21. This sequence is also repeated for each authorized vehicle in airspace 16 for each transition between cells. While in this embodiment processor 40 receives the cell map from airspace traffic controller 29 and vehicle 19 determines which cell to proceed with, it is contemplated that processor 43 may review the cell map and determine the cell or cells into which vehicle 19 should enter to progress along route 21.

Figure 10B:
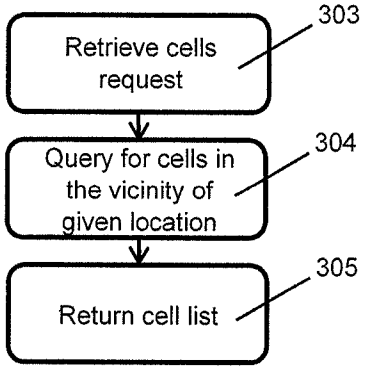
FIGS. 10A-10E are database record processing and management flow diagrams of the transaction processing engine shown in FIG. 1.
Figure 10A:
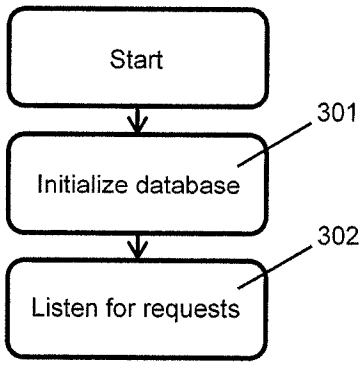

As shown in FIGS. 10A, 10B, 10C, 10D and 10E, database 37 and processor 43 provide a number of operations. As shown in FIG. 10A, to start database 37 is initialized 301 with the cell records that are being managed and the associated information for each cell shown in FIG. 9. All tokens are reset to "free" or available. Database 37 is then able to listen for or receive requests 302. As shown in FIG. 10B, before aerial vehicle 19 or 20 makes a request for a cell token or authorization on its flight path, it needs to know the map of cells in its vicinity. Such a request is received 303, a query 304 of cells in the vicinity of the vehicle's given location is made, and a cell list returned 305. This database function thereby provides a list of cells and cell spatial definitions and designators to the aerial vehicle.

Figure 10E:
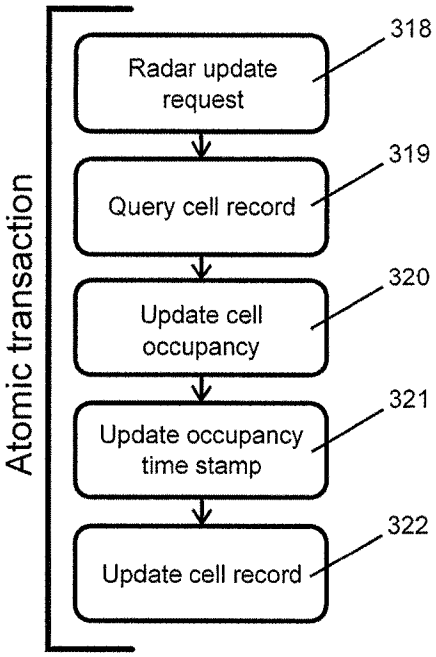
Figure 10D:
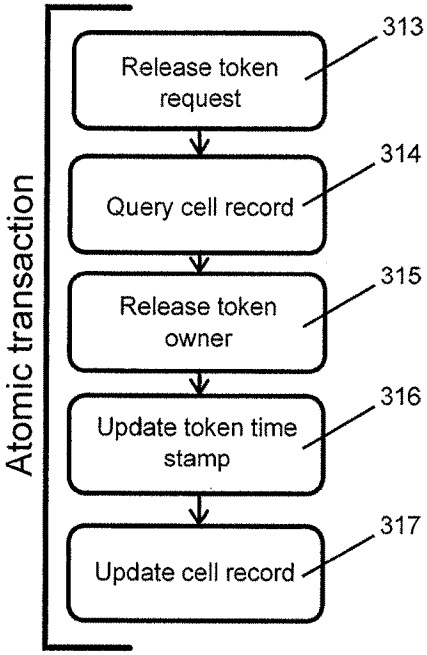
Figure 10C:
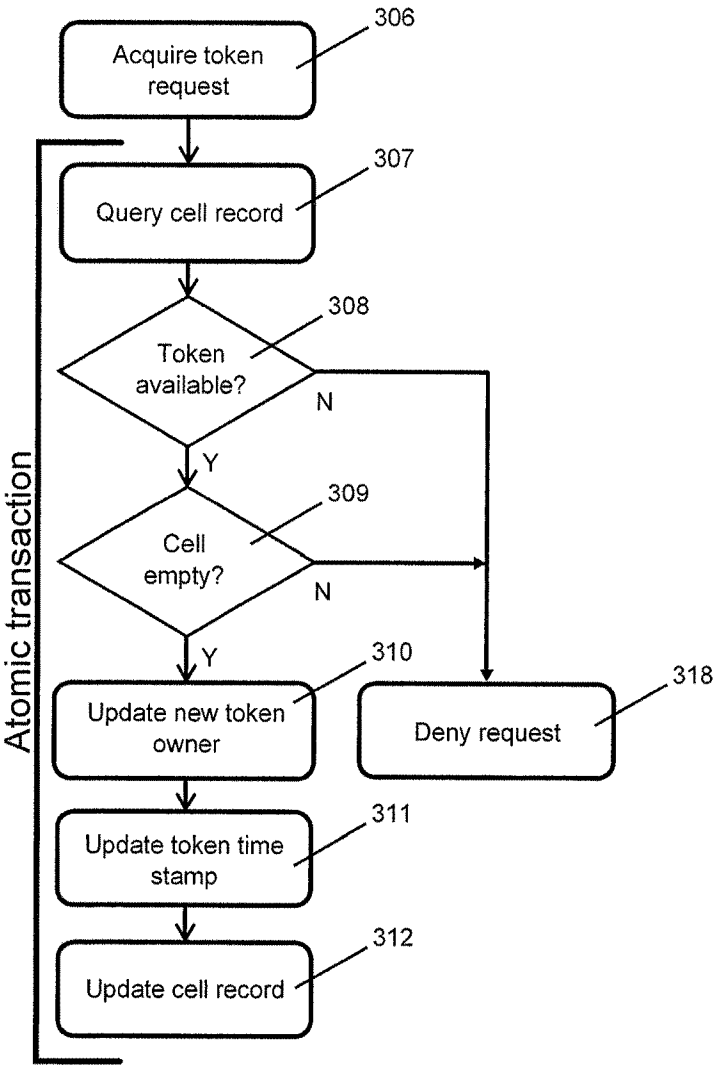

FIG. 10C shows the main database operation. Upon receiving 306 a request for a token for a subject cell, the subject cell record is retrieved 307 and checked for both token availability 308, is the token state "free," and actual occupancy 309. If either is unavailable, the request is denied 318. If both checks pass, the token is assigned to grant the access request, and database 37 cell record is updated 312 with the vehicle token assignment 310 (token state set to "assigned") and token time stamp 311 accordingly. Additional or redundant functionality may be provided. For example, time stamps may be checked to make sure the occupancy data or token state is not too old and such checks may trigger a radar verification request prior to token grant, as described below.

After an aerial vehicle has left an assigned cell, it is supposed to return or release its access token. FIG. 10D shows the routine for retrieving that token and the update of database 37 accordingly. As shown, a token release request 313 is made, the cell record is queried 314, the subject token is released by the vehicle and retrieved 315 by database 37, the subject token time stamp is updated 316 and the subject cell record updated 317 to a token state of "free" accordingly.

FIG. 10E shows a secondary optional mechanism, such as radar, being used to scan for actual cell occupancy. As shown, a radar update request 318 is made, the cell record is queried 319, cell occupancy is updated 320 accordingly, the occupancy time stamp is updated 321, and the cell token record updated 322 accordingly. Thus, information provided by the radar verification system is used to update the occupancy fields in the cell records. This verification update may be performed on demand for specific cells or by periodically scanning all cells in the background. Additional processes and functionality that manage backups, logging, integrity checks and the like may be provided.

Figure 11B:
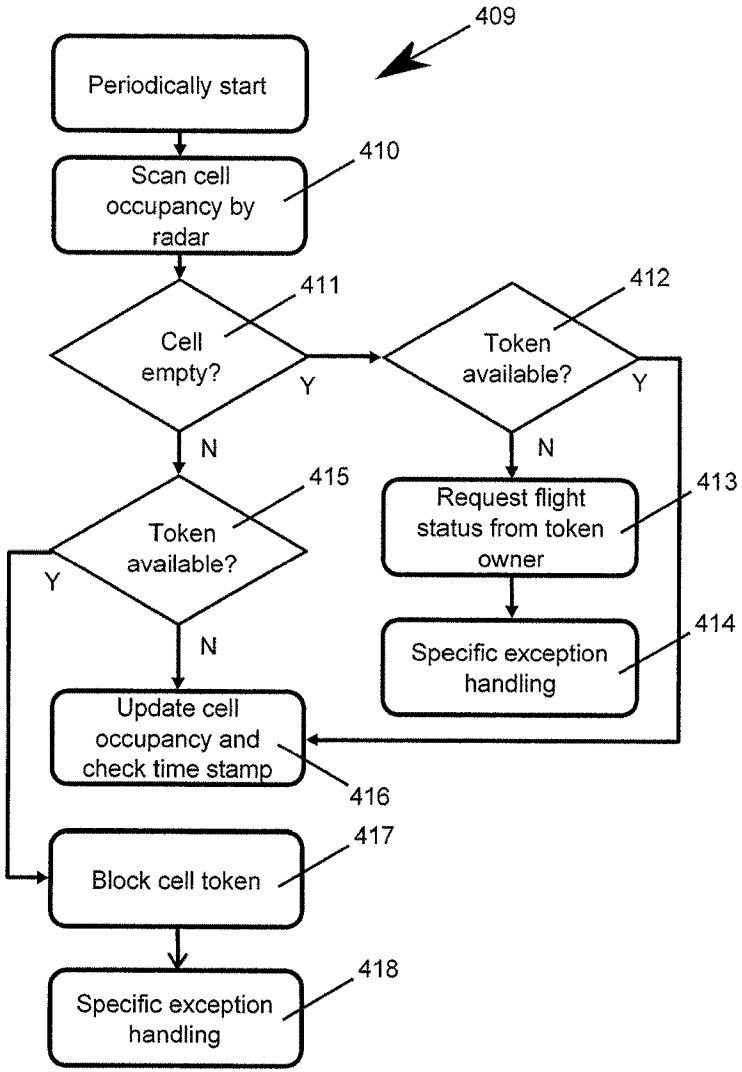
FIGS. 11A and 11B are exception processing and management flow diagrams of the transaction processing engine shown in FIG. 1.
Figure 11A:
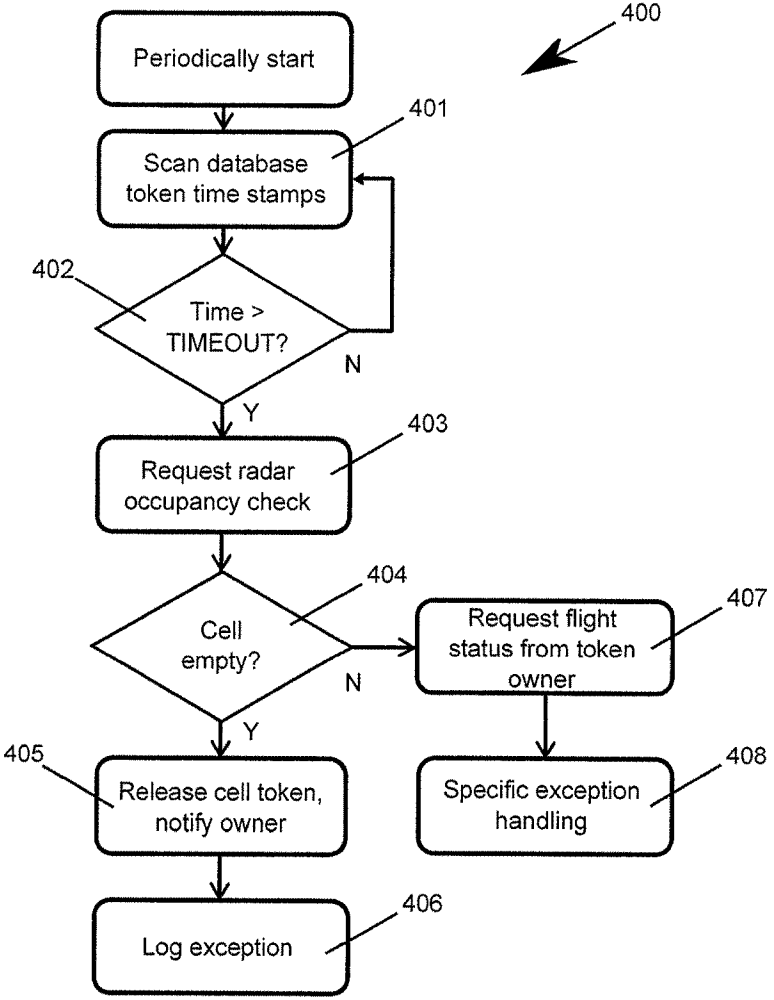

System 15 may provide certain exception functionality. FIGS. 11A and 11B show two routines that may be run periodically in the background or on request. FIG. 11A shows database time stamp check and verification process 400, which scans database token time stamps 401 to check 402 that occupied tokens have not expired (given some predefined TIMEOUT value). If it finds an expired token, it forces an occupancy check 403. If such occupancy check 404 shows a cell as being empty or clear, it retrieves the token 405, notifies its delinquent owner and logs an exception 406. If the cell is actually still occupied, it tries to get a status from its owner 407 and then deals with the exception accordingly 408, for example based on a predefined rule set.

FIG. 11B shows a radar based occupancy verification or check 409. Cell occupancy by aerial vehicles is periodically scanned 410. If a cell is empty 411 and the token is available or free 412, the check status and timestamp is updated 416 in database 37. Similarly, if a cell is occupied and the token is assigned 415, the check status and timestamp is updated 416 in database 37. However, if a cell is empty 411 but a token is assigned 412, then the owner is queried 413 and special exception handling procedures 414 are followed. If a cell is occupied but the token is recorded as free or available, the token is immediately blocked from being assigned 417 and special exception processing 418 is followed.

Thus, the UAVs operating in airspace 16 are provided with a set of regulatory requirements. The minimum requirements include a certifiably accurate way of the UAV establishing the UAV's own location relative to cell boundaries, heading and velocity, a certifiably reliable way of the UAV establishing and maintaining wireless communications with airspace traffic controller 29, a UAV controller that is certified to control the UAV such that it remains within the boundaries of a given cell should a token not be assigned for adjacent cells and forward progress or alternate paths not be available, a UAV that has a processing engine which allows it to request and acquire tokens from airspace traffic controller 29 before a new cell is entered, and a UAV that has a processing engine which allows it to release or return to airspace traffic controller 29 tokens of cells that have been vacated by the UAV.

In the embodiment shown, communication between UAVs 19 and 20 is provided by wireless cellular communication infrastructure, such as a 3G or 4G network. However, alternative communication infrastructures may be used, including without limitation ISM band radios (e.g. WIFI, ZigBee), satellite communications or proprietary license band radios. Proprietary license band radios may be used to increase the immunity of control communications from disturbances by other users using the band width for other purposes.

Accordingly, on a general level, token processing engine 29 manages and tracks the assignment and retrieval of the unique tokens that correspond to each of cells 18 in airspace 16. The authorized UAVs stay within their assigned cells and may not enter another cell without first requesting and obtaining a token for that cell. If a token for that cell has already been assigned to another UAV, it is not available. Processor 43 and database 37 execute very simple atomic transactions; they assign and retrieve tokens from UAVs in the system. Each token can be at most assigned to only a single UAV at any given time. Thus, the system has the ability to ensure that any given cell is occupied by at most one aerial vehicle at any given time. While the traffic volume of token exchanges can be very high, each unique transaction is very straightforward and simple to execute and verify. One unique token is created for each cell and stored in control database 37. Upon request and authorization, a token can be associated with a given UAV. This requires locking that token in database 37, namely by changing the token state from "free" to "assigned" in this embodiment, and wirelessly communicating the association to the requesting vehicle. A handshake protocol is employed to verify that the token state is synchronized between database 37 and the vehicle. This has to be complete prior to the vehicle entering the space controlled by the given token. Upon leaving the assigned cell space, the vehicle is responsible for returning the token to control database 37 again by using a handshake protocol resulting in the token state changing from "assigned" to "free" in this embodiment. Upon completion of the retrieval of the token for the cell, airspace traffic controller 29 makes the token and associated airspace available to other vehicles.

Depending on its speed, location, accuracy and planned flight path, a vehicle may request additional tokens for further airspace cells ahead of time or may request multiple tokens for multiple cells in a block at one time. One example of this could be a vehicle maintaining a first-in-first-out queue of tokens that are acquired and released as the vehicle proceeds in its flight path. The size of the queue may depend on token availability as well as vehicle speed and flight path, as well as certain limits that may be programmed into control processor 38 in terms of a maximum number of tokens that may be assigned to a vehicle at a given time. Token queuing can be used to reduce transaction volume as it simultaneously reduces the number of individual transactions and reduces the occupancy level of the overall air traffic control system 15.

Air traffic control system 15 may include a mechanism for validating the data used. This may include validation of vehicle data, e.g., the given location of a vehicle, by a separate method. For example, a vehicle may determine its location and speed data by using its on-board GPS unit 23. However, airspace traffic controller 29 may check these parameters independently by using an alternate technology such as radar based tracking. Although not required, radar towers 24 and 25 allow for the independent verification of the location, heading and speed of vehicles in airspace 16.

A similar mechanisms may be optionally used to verify that only the vehicle with the assigned token enters a given airspace cell and/or that the token should be released by the vehicle promptly upon exiting. Again, radar towers 24 and 25 allow for the optional independent verification of whether or not an aerial vehicle is in a particular cell 18 within airspace 16.

Database auditing and consistency checking is employed to verify that tokens are not duplicated or lost entirely. This includes the use of redundant databases distributed among multiple servers. Distributing those geographically will also mitigate the effects of any localized server outages without affecting the overall traffic flow. Dual or triple redundancy configurations may be used to ensure database consistency. The use of handshake and concurrent error checking protocols further enhance the overall reliability and safety of the system.

As indicated, control system 15 employs two techniques to safely and efficiently manage aerial traffic. As described above, the safety critical first system (lower layer) uses a token based method which is simple and straight forward to implement and certify. An efficiency optimizing second system (higher layer) may be used which is more complex and makes predictions about future traffic states.

For example, different "quality of service" categories may be assigned, e.g., to reserve lanes for faster vehicles. In addition, the system may be used to re-route traffic around congested areas. A token for an alternate path may be offered to a requesting vehicle if the originally requested cell (or cells along a predicted path) are congested. Such a system may use the historical flight path information of each vehicle in conjunction with a predictor based on factors such as previously flown paths by a vehicle, time of day, weather, and other factors or variables to optimize overall traffic flow.

In a situation of an unauthorized vehicle entering an otherwise unallocated cell, that vehicle may be given temporary authorization over that space until the situation can be resolved. This would prevent other vehicles from occupying the same airspace. However, if that cell is not empty, more drastic measures may be taken, e.g., an order to evacuate that cell immediately to both the authorized and unauthorized vehicle providing separate exit paths. This, of course, may have ripple effects on neighboring cells and current and future traffic that has to be planned and accounted for.

Airspace cells 18 are virtual constructs, but rely upon physical implementations of a common general architecture. This may require radios of appropriate range that can be implemented on top of existing infrastructures such as cell towers, street/traffic lights etc. in urban areas. For wireless links, including communications and radar based location tracking, the mitigation of multi-path conditions may be important to maintain reliable operation. Multiple micro base stations or substations may be used to ensure that there is always at least one direct path from a base station to a vehicle which will allow for time of flight based distance measurements. For position triangulations multiple direct paths may be needed. Time synchronization of the base station signals can further help to filter out multi path signals. Each base station knows its own location, e.g., by using a GPS receiver which could also be used as a timing reference. For redundancy, beacons can communicate via dedicated back-haul links as well as in a peer to peer based mesh configuration. The beacon communication links can also be used to update local firmware in the beacon controller. Similarly, while the UAVs provide their own communication links, they can utilize the beacon network as an emergency backup.

System 15 may be used in conjunction with an existing traffic control approach. For example, in the mixed traffic of manned and unmanned autonomous air vehicles, the manned air vehicles can be managed within the existing air traffic control system and given the "right of way" within the cellular system that controls only unmanned vehicles. The interface between the two systems could simply consist of a one-way signal from the manned system consisting of the location and altitude of all the vehicles. General aviation aircraft and other aircraft that fly uncontrolled would require a means of transmitting location and altitude.

As further described below, processing and management may be practiced with different computer configurations, including internet appliances, hand-held devices, wearable computers, multi-processor systems, programmable consumer electronics, network PCs, mainframe computers, a system on a chip, or a programmable logic device such as a FPGA (field programmable gate array) or a PLD (programmable logic device). Various alternative memory or database devices may be included with the computer, such as flash memory, a hard disk drive, or other solid state memory device. The programming can be embodied in any form of computer-readable medium or a special purpose computer or data processor that is programmed, configured or constructed to perform the subject instructions. The term computer or processor as used herein refers to any of the above devices as well as any other data processor. Some examples of processors are microprocessors, microcontrollers, CPUs, PICs, PLCs, PCs or microcomputers. A computer-readable medium comprises a medium configured to store or transport computer readable code, or in which computer readable code may be embedded. Some examples of computer-readable medium are CD-ROM disks, ROM cards, floppy disks, flash ROMS, RAM, nonvolatile ROM, magnetic tapes, computer hard drives, conventional hard disks, and servers on a network. The computer systems described above and below are for purposes of example only. The described embodiments and methods may be implemented in any type of computer system or programming or processing environment. In addition, it is meant to encompass processing that is performed in a distributed computing environment, were tasks or modules are performed by more than one processing device or by remote processing devices that are run through a communications network, such as a local area network, a wide area network or the internet. Thus, the term computer is to be interpreted expansively and exemplary embodiments of the present system are described largely in the context of a fully functional computer system for executing an air traffic control system. Accordingly, the control system may be embodied in a computer program product disposed on signal bearing media for use with any suitable data processing system. Such signal bearing media may be transmission media or recordable media for machine-readable information, including magnetic media, optical media, or other suitable media. Examples of recordable media include magnetic disks in hard drives or diskettes, compact disks for optical drives, magnetic tape, solid state memory devices, and others as will occur to those of skill in the art. Examples of transmission media include telephone networks for voice communications and digital data communications networks such as, for example, Ethernets™ and networks that communicate with the Internet Protocol and the World Wide Web. Persons skilled in the art will immediately recognize that any computer system having suitable programming means will be capable of executing the steps of the disclosed method as embodied in a program product. Persons skilled in the art will recognize immediately that, although some of the exemplary embodiments described in this specification are oriented to software installed and executing on computer hardware, nevertheless, alternative embodiments implemented as firmware or as hardware are well within the scope of the present disclosure.

The flowcharts and block diagrams in FIGS. 5-11 illustrate the architecture, functionality, and operation of possible implementations of systems and methods according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Digital systems generally include one or more processors that execute software, and various hardware devices that can be controlled by the software. For example, digital systems include computer systems such as desktops, laptops, net tops, servers, workstations, etc.; mobile devices such as cellular phones, personal digital assistants, smart phones, etc.; and other special purpose devices. The hardware devices may generally provide certain functionality such as storage (e.g. disk drives, flash memory, optical drives, etc.), communications (e.g. networking, wireless operation, etc.), and other input/output functionality (touch screen, keyboard, mouse, display, audio, etc.). The illustrated computing devices include a main memory, such as random access memory (RAM), and may also include a secondary memory. Secondary memory may include, for example, a hard disk drive, a removable storage drive or interface, connected to a removable storage unit, or other similar means. As will be appreciated by persons skilled in the relevant art, a removable storage unit includes a computer usable storage medium having stored therein computer software and/or data. Examples of additional means creating secondary memory may include a program cartridge and cartridge interface (such as that found in video game devices), a removable memory chip (such as an EPROM, or PROM) and associated socket, and other removable storage units and interfaces which allow software and data to be transferred from the removable storage unit to the computer system. In some embodiments, to "maintain" data in the memory of a computing device means to store that data in that memory in a form convenient for retrieval as required by the algorithm at issue, and to retrieve, update, or delete the data as needed.

The processing and management computing devices may include a communications interface. The communications interface allows software and data to be transferred between the computing device and external devices. The communications interface may include a modem, a network interface (such as an Ethernet card), a communications port, a PCMCIA slot and card, or other means to couple the computing device to external devices. Software and data transferred via the communications interface may be in the form of signals, which may be electronic, electromagnetic, optical, or other signals capable of being received by the communications interface. These signals may be provided to the communications interface via wire or cable, fiber optics, a phone line, a cellular phone link, and radio frequency link or other communications channels. In some embodiments, a device or component is "coupled" to a computing device if it is so related to that device that the product or means and the device may be operated together as one machine. In particular, a piece of electronic equipment is coupled to a computing device if it is incorporated in the computing device, attached to the device by wires capable of propagating signals between the equipment and the device, tethered to the device by wireless technology that replaces the ability of wires to propagate signals, or related to the computing device by shared membership in some network consisting of wireless and wired connections between multiple machines. A computing device may be coupled to a second computing device; for instance, a server may be coupled to a client device. The communications interface in the system embodiments discussed herein facilitates the coupling of the computing device with data entry devices such as GPS and network connections, whether wired or wireless. In some embodiments, "data entry devices" are any equipment coupled to a computing device that may be used to enter data into that device. This definition includes, without limitation, keyboards, computer mice, touchscreens, digital cameras, digital video cameras, wireless antennas, GPS devices, gyroscopic orientation sensors, proximity sensors, compasses, scanners, and specialized reading devices, and any hardware device capable of sensing electromagnetic radiation, electromagnetic fields, gravitational force, electromagnetic force, temperature, vibration, pressure, air speed and the like. A computing device's "manual data entry devices" is the set of all data entry devices coupled to the computing device that permit the user to enter data into the computing device using manual manipulation. Manual entry devices include without limitation keyboards, keypads, touchscreens, track-pads, computer mice, buttons, and other similar components. As discussed above, the processing and management computing devices may also possess a navigation facility. The computing device's "navigation facility" may be any facility coupled to the computing device that enables the device accurately to calculate the device's location on the surface of the Earth. Navigation facilities can include a receiver configured to communicate with the Global Positioning System or with similar satellite networks, as well as any other system that mobile phones or other devices use to ascertain their location, for example by communicating with cell towers.

A code scanner coupled to a computing device is a device that can extract information from a "code" attached to an object. In one embodiment, a code contains data concerning the object to which it is attached that may be extracted automatically by a scanner; for instance, a code may be a bar code whose data may be extracted using a laser scanner. A code may include a quick-read (QR) code whose data may be extracted by a digital scanner or camera. A code may include a radiofrequency identification (RFID) tag; the code may include an active RFID tag. The code may include a passive RFID tag. A computing device may also be coupled to a code exporter; in an embodiment, a code exporter is a device that can put data into a code. For instance, where the code is a two-dimensional image printed on paper, or a three dimensional printed object, or another object, the code exporter may be a printer. Where the code is a non-writable RFID tag, the code exporter may be a device that can produce a non-writable RFID tag. Where the code is a writable RFID tag, the code exporter may be an RFID writer; the code exporter may also be a code scanner, in some embodiments. In some embodiments, a computing device's "display" is a device coupled to the computing device, by means of which the computing device can display images. Display include without limitation monitors, screens, television devices, and projectors.

Computer programs (also called computer control logic) are stored in main memory and/or secondary memory. Computer programs may also be received via the communications interface. Such computer programs, when executed, enable the processor device to implement the system embodiments discussed above. Accordingly, such computer programs represent controllers of the system. Where embodiments are implemented using software, the software may be stored in a computer program product and loaded into the computing device using a removable storage drive or interface, a hard disk drive, or a communications interface. The computing device may also store data in database accessible to the device. A database is any structured collection of data. Databases can include "NoSQL" data stores, which store data in a few key-value structures such as arrays for rapid retrieval using a known set of keys (e.g. array indices). Another possibility is a relational database, which can divide the data stored into fields representing useful categories of data. As a result, a stored data record can be quickly retrieved using any known portion of the data that has been stored in that record by searching within that known datum's category within the database, and can be accessed by more complex queries, using languages such as Structured Query Language, which retrieve data based on limiting values passed as parameters and relationships between the data being retrieved. More specialized queries, such as image matching queries, may also be used to search some databases. A database can be created in any digital memory.

Persons skilled in the relevant art will also be aware that while any computing device must necessarily include facilities to perform the functions of a processor, a communication infrastructure, at least a main memory, and usually a communications interface, not all devices will necessarily house these facilities separately. For instance, in some forms of computing devices as defined above, processing and memory could be distributed through the same hardware device, as in a neural net, and thus the communications infrastructure could be a property of the configuration of that particular hardware device. Many devices do practice a physical division of tasks as set forth above, however, and practitioners skilled in the art will understand the conceptual separation of tasks as applicable even where physical components are merged.

The processing and management systems may be deployed in a number of ways, including on stand-alone computing devices, a set of computing devices working together in a network, or a web application. Persons of ordinary skill in the art will recognize a web application as a particular kind of computer program system designed to function across a network, such as the Internet. Web application platforms typically include at least one client device, which is a computing device as described above. The client device connects via some form of network connection to a network, such as the Internet. The network may be any arrangement that links together computing devices, and includes without limitation local and international wired networks including telephone, cable, and fiber-optic networks, wireless networks that exchange information using signals of electromagnetic radiation, including cellular communication and data networks, and any combination of those wired and wireless networks. Also connected to the network is at least one server, which is also a computing device as described above, or a set of computing devices that communicate with each other and work in concert by local or network connections. Of course, practitioners of ordinary skill in the relevant art will recognize that a web application can, and typically does, run on several servers and a vast and continuously changing population of client devices. Computer programs on both the client device and the server configure both devices to perform the functions required of the web application. Web applications can be designed so that the bulk of their processing tasks are accomplished by the server, as configured to perform those tasks by its web application program, or alternatively by the client device. Some web applications are designed so that the client device solely displays content that is sent to it by the server, and the server performs all of the processing, business logic, and data storage tasks. Such "thin client" web applications are sometimes referred to as "cloud" applications, because essentially all computing tasks are performed by a set of servers and data centers visible to the client only as a single opaque entity, often represented on diagrams as a cloud.

While the presently preferred form of the air traffic control system has been shown and described, and several modifications thereof discussed, persons skilled in this art will readily appreciate that various additional changes and modifications may be made without departing from the scope of the invention, as defined and differentiated by the claims.

What is claimed is:

1. An air traffic control method comprising the steps of:

providing an unmanned aerial vehicle;

providing a traffic controller having a processor and being in wireless signal communication with said unmanned aerial vehicle;

partitioning a three-dimensional airspace into multiple individual three-dimensional cells and storing said multiple individual three-dimensional cells in said traffic controller as individual virtual cells;

assigning a unique authorization token to each individual virtual cell stored in said traffic controller and storing said token for each individual virtual cell in said traffic controller;

said traffic controller processor operatively configured (i) to assign a token for a selected virtual cell to a selected unmanned aerial vehicle and (ii) to release assignment of said token for said selected virtual cell after said selected unmanned aerial vehicle leaves said airspace of said selected virtual cell;

selecting an individual virtual cell in a flight path of said unmanned aerial vehicle in said airspace;

sending a signal to said traffic controller requesting assignment of said token for said selected cell to said unmanned aerial vehicle;

said traffic controller processor determining whether or not to assign said token for said selected cell to said unmanned aerial vehicle as a function of whether or not said token for said selected cell is available for assignment to said unmanned aerial vehicle; and restricting said unmanned aerial vehicle from entering airspace of said selected cell without said unmanned aerial vehicle first being assigned said token for said selected cell by said traffic controller processor.

2. The method set forth in claim 1, comprising the step of assigning said token for said selected cell to said unmanned aerial vehicle.

3. The method set forth in claim 2, comprising the step of said unmanned aerial vehicle entering airspace of said selected cell from airspace of an adjacent cell.

4. The method set forth in claim 3, comprising the step of releasing assignment of said token for said adjacent cell after said unmanned aerial vehicle leaves said airspace of said adjacent cell.

5. The method set forth in claim 3, comprising the step of releasing assignment of said token for said adjacent cell to said unmanned aerial vehicle after a predetermined expiration time.

6. The method set forth in claim 1, wherein said selected cell is in a desired aerial route of said unmanned aerial vehicle in said airspace.

7. The method set forth in claim 1, wherein said unmanned aerial vehicle comprises an onboard global position system, and comprising the step of determining the cell of said airspace in which said unmanned aerial vehicle is located.

8. The method set forth in claim 1, wherein said step of determining whether or not to assign said token for said selected cell to said unmanned aerial vehicle is a function of a radar system that verifies whether or not said selected cell is available to said unmanned aerial vehicle.

9. The method set forth in claim 1, wherein said step of determining whether or not to assign said token for said selected cell to said unmanned aerial vehicle is a function of a priority designation applied to said unmanned aerial vehicle.

10. The method set forth in claim 1, and further comprising the step of auditing token assignments to assure that each token is assigned to only one unmanned aerial vehicle at a time.

11. The method set forth in claim 1, comprising the step of determining a destination cell of said unmanned aerial vehicle in said airspace and calculating an aerial route to said destination cell.

12. The method set forth in claim 11, comprising the step of calculating an alternate aerial route to said destination cell.

13. The method set forth in claim 1, wherein said virtual cells do not have the same volume.

14. The method set forth in claim 1, wherein said step of requesting assignment of said token for said selected cell to said unmanned aerial vehicle comprises the step of sending a wireless signal via a wireless communication network from said unmanned aerial vehicle to a ground control system.

15. The method set forth in claim 14, wherein said wireless communication network comprises a cellular infrastructure and dedicated frequency channels.

16. The method set forth in claim 1, comprising the step of assigning a second token for a second selected cell to said unmanned aerial vehicle.

17. The method set forth in claim 16, comprising the step of restricting said unmanned aerial vehicle from acquiring more than a predetermined maximum number of tokens at a given time.

18. An unmanned aerial vehicle traffic control system comprising:

a ground system;

an unmanned aerial vehicle having a controller;

a wireless communications link between said ground system and said unmanned aerial vehicle;

said unmanned aerial vehicle configured and arranged to travel in a three-dimensional airspace;

said three-dimensional airspace partitioned into multiple individual three-dimensional cells, wherein said multiple individual three-dimensional cells are stored in said ground system as individual virtual cells;

a database having a unique authorization token associated with each of said virtual cells;

a transaction processing engine configured (i) to assign each token in said database to no more than one unmanned aerial vehicle at a time, (ii) to assign a token in said database for a selected virtual cell to a selected unmanned aerial vehicle, and (iii) to release in said database assignment of said token for said selected virtual cell after said selected unmanned aerial vehicle leaves said airspace of said selected virtual cell; and said controller configured to control said unmanned aerial vehicle such that said unmanned aerial vehicle is restricted from entering airspace of a selected cell without first being assigned said token for said selected cell by said transaction processing engine.

19. The system set forth in claim 18, wherein said transaction processing engine is configured to release assignment of said token for said selected cell to said unmanned vehicle after said unmanned aerial vehicle leaves airspace of said selected cell.

20. The system set forth in claim 19, wherein said transaction processing engine is configured to release assignment of said token for said selected cell to said unmanned vehicle after said unmanned aerial vehicle leaves airspace of said selected cell as a function of elapsed time from assignment of said token to said unmanned aerial vehicle.

21. The system set forth in claim 18, wherein said unmanned aerial vehicle comprises a global positioning system.

22. The system set forth in claim 18, wherein said ground system comprises a radar system and said transaction processing engine is configured to obtain a verification from said radar system that a cell is available to an unmanned aerial vehicle before assigning a token for said cell to said unmanned aerial vehicle.

23. The system set forth in claim 18, wherein said transaction processing engine is configured to audit token assignments to assure that each token is assigned to only one unmanned aerial vehicle at a time.

24. The system set forth in claim 18, wherein said ground system comprises multiple separately located ground stations.

25. The system set forth in claim 18, comprising multiple unmanned aerial vehicles.

26. The system set forth in claim 18, wherein said wireless communications link between said ground system and said unmanned aerial vehicle comprises a cellular infrastructure and dedicated frequency channels.

27. The system set forth in claim 18, further comprising a redundant backup database to said database.

28. The system set forth in claim 18, wherein said transaction processing engine is configured to assign multiple tokens in said database to one unmanned aerial vehicle at the same time.

29. The system set forth in claim 28, wherein said transaction processing engine is configured to restrict said unmanned aerial vehicle from acquiring more than a predetermined maximum number of tokens at a given time.

30. An air traffic control system comprising:

a three-dimensional airspace partitioned into multiple individual three-dimensional virtual cells;

a unique authorization token for each of said virtual cells;

a traffic controller having a processor configured (i) to assign each of said tokens to no more than one aerial vehicle at a time, (ii) to assign a token for a selected virtual cell to a selected aerial vehicle, (iii) to release assignment of said token for said selected virtual cell after said selected aerial vehicle leaves said airspace of said selected virtual cell, and (iv) to determine whether or not to assign said token for a selected cell to an aerial vehicle as a function of whether or not said token for said selected cell is available for assignment to said aerial vehicle;

a communications network between said aerial vehicle and said traffic controller configured to allow said traffic controller processor to selectively assign said tokens to said aerial vehicle; and a vehicle controller configured to control said aerial vehicle such that said aerial vehicle is restricted from flying into airspace of a selected cell without being assigned s aid token for said selected cell by said traffic controller processor.

31. The system set forth in claim 30, wherein said communications network between said aerial vehicle and said traffic controller is configured to allow said traffic controller to selectively release assignment of said tokens to said aerial vehicle.

32. The system set forth in claim 30, wherein said vehicle controller is configured to selectively request and receive assignment of said tokens.

33. The system set forth in claim 30, wherein said vehicle controller is configured to selectively release assignment of said tokens.

34. The system set forth in claim 30, wherein said traffic controller selectively records either an assigned or a free token state in a database.

* * * * *